US011883922B2

(12) United States Patent
Watanabe et al.

(10) Patent No.: US 11,883,922 B2
(45) Date of Patent: Jan. 30, 2024

(54) SUBSTRATE PROCESSING APPARATUS

(71) Applicant: EBARA CORPORATION, Tokyo (JP)

(72) Inventors: Yuki Watanabe, Tokyo (JP); Keita Yagi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 365 days.

(21) Appl. No.: 16/201,546

(22) Filed: Nov. 27, 2018

(65) Prior Publication Data

US 2019/0160626 A1 May 30, 2019

(30) Foreign Application Priority Data

Nov. 29, 2017 (JP) ..... 2017-228967

(51) Int. Cl.
*B24B 37/005* (2012.01)
*B24B 37/32* (2012.01)
*B24B 37/013* (2012.01)
*B24B 37/20* (2012.01)

(52) U.S. Cl.
CPC ..... *B24B 37/005* (2013.01); *B24B 37/013* (2013.01); *B24B 37/205* (2013.01); *B24B 37/32* (2013.01)

(58) Field of Classification Search
CPC ... B24B 37/005; B24B 37/013; B24B 37/205; B24B 37/32; H01L 21/304
USPC ..... 451/5
See application file for complete search history.

(56) References Cited

U.S. PATENT DOCUMENTS 5,838,447 A 11/1998 Hiyama et al.
2006/0009127 A1* 1/2006 Sakurai ..... B24B 37/005 451/5
2007/0243795 A1 10/2007 Kobayashi et al.
2008/0242081 A1 10/2008 Idani
2012/0019830 A1 1/2012 Kimba
(Continued)

FOREIGN PATENT DOCUMENTS

CN 104889879 A 9/2015
CN 106457507 A 2/2017
(Continued)

OTHER PUBLICATIONS

Translation of WO2015163134A1, retrieved from Espacenet on Mar. 1, 2021 (Year: 2015).*

*Primary Examiner* — Tom Rodgers
(74) *Attorney, Agent, or Firm* — BakerHostetler

(57) ABSTRACT

A substrate processing apparatus includes a polishing head defining plural pressure chambers D1 to D5 for pressing a wafer W on a polishing pad 42, a pressure control unit performing pressure feedback control by individually controlling pressures in the pressure chambers D1 to D5, a film thickness measurement unit measuring a film thickness distribution of the wafer W being polished, a storage unit storing multiple pieces of information on a preset pressure of the pressure chambers D1 to D5, and a response characteristic acquisition unit changing the preset pressure every time a predetermined condition is satisfied during polishing of the wafer W, measuring a polishing rate applied to the wafer W, and acquiring a response characteristic of the polishing of the wafer W. The response characteristic indicates responsiveness of the polishing of the wafer W to the pressure feedback. The response characteristic is acquired based on the obtained polishing rates.

4 Claims, 7 Drawing Sheets

(56) References Cited

U.S. PATENT DOCUMENTS

| | | | | |
|---|---|---|---|---|
| 2015/0255357 | A1 | 9/2015 | Kobayashi et al. | |
| 2015/0266159 | A1* | 9/2015 | Shiokawa | H01L 22/12 451/5 |
| 2017/0148655 | A1 | 5/2017 | Kobayashi et al. | |
| 2017/0190020 | A1 | 7/2017 | Kobayashi et al. | |
| 2018/0264619 | A1 | 9/2018 | Yoshida | |

FOREIGN PATENT DOCUMENTS

| | | | | |
|---|---|---|---|---|
| CN | 106863108 | A | 6/2017 | |
| JP | 2000-094301 | A | 4/2000 | |
| JP | 2004-001227 | A | 1/2004 | |
| JP | 2006-043873 | A | 2/2006 | |
| JP | 2008-503356 | A | 2/2008 | |
| JP | 2012-028554 | A | 2/2012 | |
| JP | 2015-193068 | A | 11/2015 | |
| KR | 2015-0110347 | A | 10/2015 | |
| WO | WO-2015163164 | A1 * | 10/2015 | B24B 37/013 |
| WO | WO 2017/056636 | A1 | 4/2017 | |

* cited by examiner

| | Preset Pressure | | | | |
|---|---|---|---|---|---|
| | Pressure Chamber 1 | Pressure Chamber 2 | Pressure Chamber 3 | Pressure Chamber 4 | Pressure Chamber 5 |
| Condition 1 | A1P | A2P | A3P | A4P | A5P |
| Condition 2 | A1P*0.9 | A2P | A3P | A4P | A5P |
| Condition 3 | A1P*1.1 | A2P | A3P | A4P | A5P |
| Condition 4 | A1P | A2P*0.9 | A3P | A4P | A5P |
| Condition 5 | A1P | A3P*1.1 | A3P | A4P | A5P |
| Condition 6 | A1P | A2P | A4P*0.9 | A4P | A5P |
| Condition 7 | A1P | A2P | A4P*1.1 | A4P | A5P |
| ⋮ | | | | | |
| Condition M | | | | | |

SUBSTRATE PROCESSING APPARATUS

CROSS-REFERENCE TO RELATED APPLICATIONS

This application claims the benefit of Japanese Priority Patent Application JP 2017-228967 filed on Nov. 29, 2017, the entire contents of which are incorporated herein by reference.

FIELD

The preset invention relates to a substrate processing apparatus that processes a surface of a substrate such as a semiconductor wafer.

BACKGROUND AND SUMMARY

Manufacturing processes for manufacturing semiconductor devices typically use a polishing device for polishing treatment on a surface of a substrate such as a semiconductor wafer. The polishing device of this type typically rotates the wafer while the wafer is held by a substrate holding device called top ring or polishing head. In this state, while a polishing table is rotated together with the polishing pad, the surface of the wafer is pressed against the polishing surface of the polishing pad, the surface of the wafer is brought into sliding contact with the polishing surface in the presence of polishing liquid, and thus the surface of the wafer is polished.

Such a state of the art polishing device experiences insufficient or excessive polishing depending on the pressing forces imparted to the respective portions of the wafer if the relative pressing force between the wafer that is being polished and the polishing surface of the polishing pad is not uniform over the entire surface of the wafer. In view of this, in order to realize a uniform pressing force for the wafer, multiple pressure chambers formed by an elastic film are often provided at the lower portion of the polishing head to implement feedback control on the pressures of these multiple pressure chambers and thereby control the pressing force acting upon the wafer that is being polished (for example, see National Publication of International Patent Application No. 2008-503356).

Further, according to another known substrate polishing device, in addition to the pressure chambers of the polishing head, the pressure in the pressure chamber in the retainer ring provided around them is feedback-controlled to achieve more accurate control of the film thickness profile (see Japanese Patent Laid-Open No. 2015-193068).

Feedback control of the pressures of these pressure chambers presupposes knowledge of a response characteristic of the substrate polishing device (the characteristic of the amount of polishing per unit time). The response characteristic fluctuates depending upon polishing conditions such as wafer types and polishing environment (slurry types, types of the polishing head, types of the polishing pad, etc.) and the response characteristic should be preferably acquired under various polishing conditions.

A response characteristic under a certain polishing condition can be obtained by the following process. Multiple pressure conditions different from each other are specified for the pressure chambers constituting the substrate polishing device. The wafer is polished under the individual pressure conditions, the wafer that has been polished is taken out to measure its film thickness distribution (the film thickness distribution corresponding to multiple locations in the wafer) and thereby acquire the film thickness data indicative of the film thickness before and after the polishing, and the polishing rate is computed based on the film thickness data. This process is repeated to acquire the polishing rates corresponding to the individual pressure conditions. Further, multiple linear regression analysis is performed on the data of the polishing rates corresponding to all the pressure conditions that have been obtained, and thus the response characteristic can be obtained.

According to the traditional scheme, when a response characteristic under a certain polishing condition is to be obtained, numerous wafers need to be polished, which understandably requires the prolonged time for polishing of the wafers. In addition, much more wafers and a much longer polishing time will be necessary for obtaining the response characteristic that corresponds to multiple polishing conditions.

Further, since a wafer that is being polished moves inside of the polishing head of the substrate polishing device, an error occurs between the film thickness distribution that has been obtained by the measurement of the film thickness after the polishing and the actual film thickness distribution during the polishing, making it difficult to obtain an accurate response characteristic.

An object of the present invention, which has been made in view of the foregoing problems, is to provide a substrate processing apparatus that is capable of accurately obtaining a response characteristic of polishing of a substrate such as a wafer in a simplified manner.

According to an aspect of the present invention, provided is a substrate processing apparatus that polishes a substrate by pressing the substrate against a polishing pad. The substrate processing device includes a polishing head, a pressure control unit, a film thickness measurement unit, a storage unit, and a response characteristic acquisition unit. The polishing head defines a plurality of pressure chambers for pressing the substrate. The pressure control unit is configured to perform pressure feedback control by individually controlling pressures in the pressure chambers. The film thickness measurement unit is configured to measure a film thickness distribution of the substrate that is being polished. The storage unit is configured to store multiple pieces of information on a preset pressure of the pressure chambers. The response characteristic acquisition unit is configured to change the preset pressure every time a predetermined condition is satisfied during polishing of the substrate, measure a polishing rate applied to the substrate, and acquire a response characteristic of the polishing of the substrate. The response characteristic indicates responsiveness of the polishing of the substrate to the pressure feedback in the pressure chambers, and the response characteristic is acquired on the basis of a plurality of the obtained polishing rates.

In the above-described substrate processing apparatus, it is preferable that the preset pressure is changed when a certain period of time has elapsed or an amount of the polishing of the substrate has reached a predetermined amount. Also, it is preferable that a plurality of the preset pressures include a reference pressure condition including reference values for the pressure chambers and a plurality of preset pressure conditions obtained by changing only the pressure value in one pressure chamber from the reference pressure condition. Further, it is preferable to measure the polishing rates by performing the polishing on one substrate under the preset pressures in sequence to measure a plurality of the polishing rates.

In the above-described substrate processing apparatus, it is preferable to acquire a reference rate indicative of temporal change of a polishing rate on the basis of the reference pressure condition, perform standardization of the polishing rate that has been obtained by performing the polishing under the preset pressures in sequence, the standardization being performed on the basis of the reference rate, and thereby correct the polishing rate. By virtue of this, it is made possible to reduce the influence of the temporal change of the polishing rate as much as possible.

DETAILED DESCRIPTION OF NON-LIMITING EXAMPLE EMBODIMENTS

Figure 1:
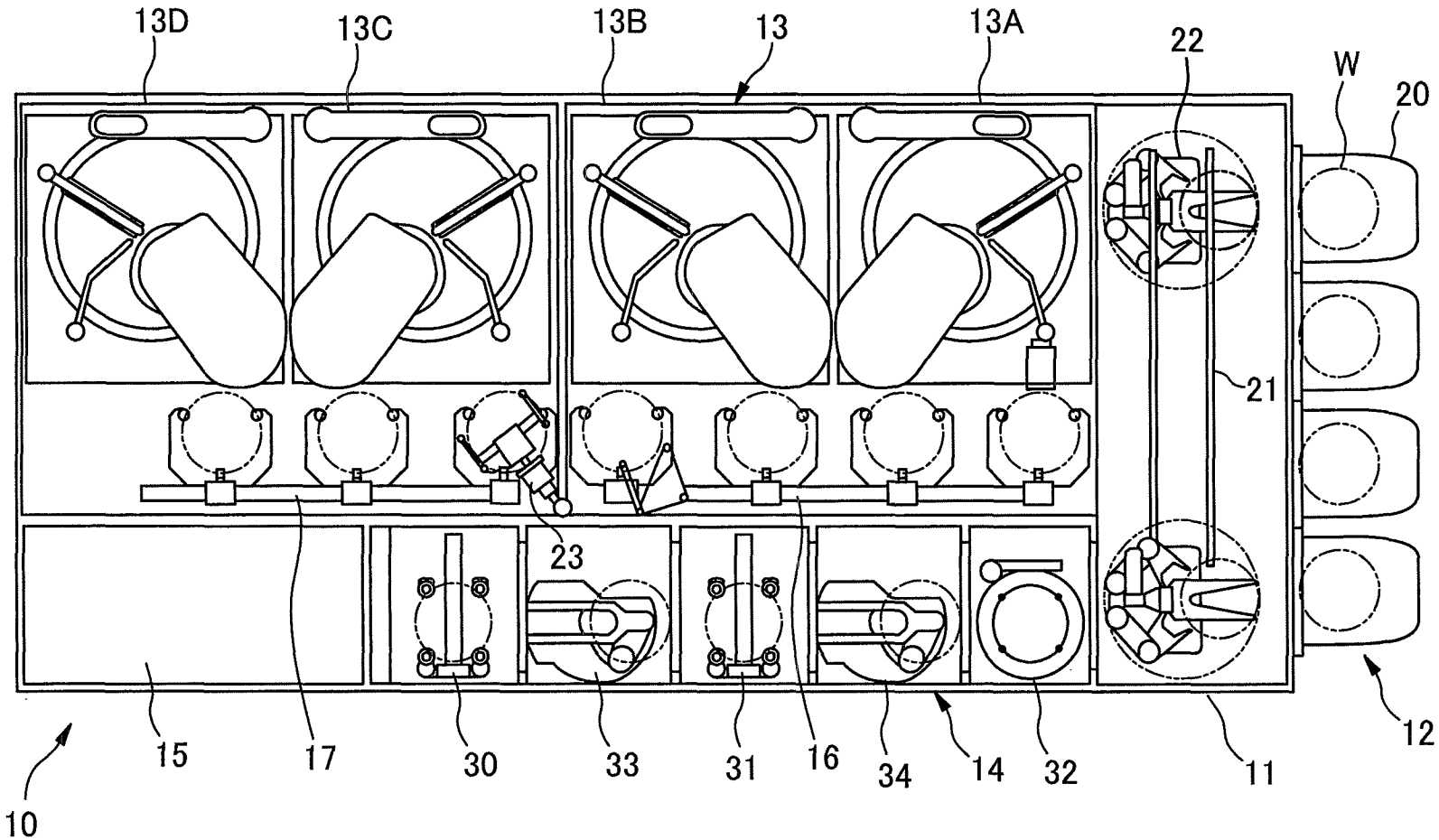
FIG. 1 is a plan view schematically illustrating a configuration of a substrate processing apparatus according to one embodiment of the present invention.

A substrate processing apparatus according to an embodiment of the present invention will be described hereinbelow with reference to the drawings. Note that the same or corresponding elements are denoted by the same reference numerals and explanations thereof will not be repeated to avoid redundancy.

FIG. 1 is a plan view that illustrates the overall configuration of the substrate processing apparatus. The substrate processing apparatus 10 is partitioned into a load/unload unit 12, a polishing unit 13, and a cleaning unit 14, which are provided inside a rectangular housing 11. Also, the substrate processing apparatus 10 has a control device 15 configured to control operations associated with processes such as conveyance, polishing, cleaning, etc. of the substrate.

The load/unload unit 12 includes a plurality of front loading units 20, a traveling mechanism 21, and two conveying robots 22. A substrate cassette for stocking a large number of substrates (substrates) is placed on the front loading unit 20. The conveying robots 22 have two hands at the top and bottom, respectively, and is configured to move on the traveling mechanism 21 and take out a substrate W from the substrate cassette on the front loading unit 20 and send it to the polishing unit 13, and place the substrate that has been subjected to the processing and sent from the cleaning unit 14 again in the substrate cassette.

The polishing unit 13 is a section for polishing (flattening) the substrate, and a plurality of polishing unit components 13A to 13D are provided and arranged in a direction defined by and in parallel with the length of the substrate processing device. Each polishing unit component includes a top ring for polishing the substrate W on a polishing table while pressing the substrate W against the polishing pad, a polishing liquid supply nozzle for supplying polishing liquid and dressing liquid to the polishing pad, a dresser configured to perform dressing of the polishing surface of the polishing pad, and an atomizer configured to spray a mixed fluid of liquid and gas or a misty liquid onto the polishing surface to wash off polishing waste and abrasive particles remaining on the polishing surface.

First and second linear transporters 16, 17 are provided between the polishing unit 13 and the cleaning unit 14 as a conveyance mechanism for conveying the substrate W. The first linear transporter 16 is configured to be movable to be positioned at a first position where the substrate W is received from the load/unload unit 12, second and third positions where the substrate W is delivered to and from the polishing unit components 13A and 13B, and a fourth position where the substrate W is delivered to and from the second linear transporter 17.

The second linear transporter 17 is configured to be movable to be positioned at a fifth position where the substrate W is received from the first linear transporter 16, and sixth and seventh positions where the substrate W is delivered to and from the polishing unit components 13C, 13D. A swing transporter 23 configured to send the substrate W to the cleaning unit 14 is provided between these transporters 16, 17.

The cleaning unit 14 includes a first substrate cleaning device 30, a second substrate cleaning device 31, a substrate drying device 32, and conveying robots 33, 34 configured to deliver substrates to and from these devices. The substrate W that has been subjected to the polishing process by the polishing unit component is cleaned by the first substrate cleaning device 30 (initial cleaning) and then further cleaned by the second substrate cleaning device 31 (finish cleaning). The substrate that has been cleaned is conveyed from the second substrate cleaning device 31 to the substrate drying device 32 to be subjected to spin drying. The substrate W that has been dried is returned to the load/unload unit 12.

Figure 2:
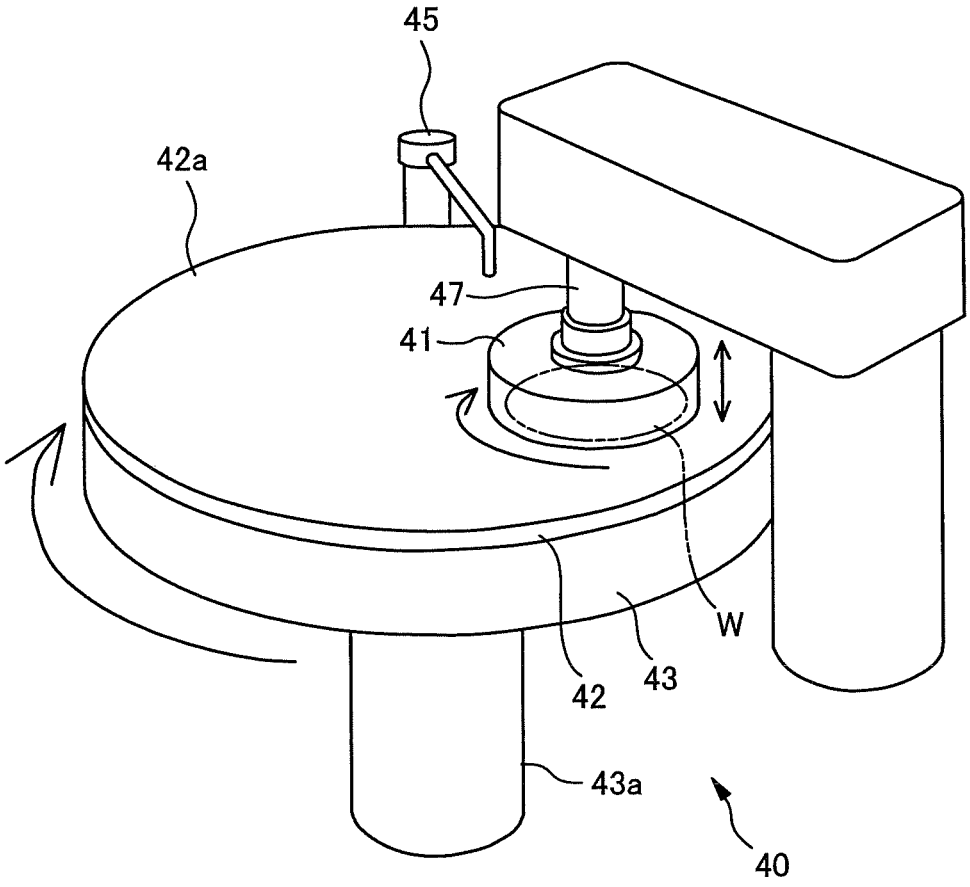
FIG. 2 is a perspective view schematically illustrating the embodiment of a substrate polishing unit component.

FIG. 2 is a perspective view that schematically illustrates the configuration of the polishing unit component. The polishing unit component 40 includes a top ring (substrate holding device) 41 configured to hold and rotate a wafer (substrate) W, a polishing table 43 configured to support the polishing pad 42, and a polishing liquid supply nozzle 45 configured to supply slurry (polishing liquid) to the polishing pad 42. Also, a film thickness measurement device 50 illustrated in FIG. 3 is provided under the polishing pad 42.

The top ring 41 is rotatably supported by a top ring shaft 47 and, configured to be capable of holding the wafer W on the lower surface thereof by vacuum suction. Also, the polishing table 43 is configured to be rotatable about a table shaft 43*a* by a not-shown motor. The top ring 41 and the polishing table 43 rotate in the direction indicated by the arrow and, in this state, the top ring 41 presses the wafer W onto the polishing surface 42*a* on the upper side of the polishing pad 42. In the presence of the polishing liquid supplied from the polishing liquid supply nozzle 45 onto the polishing pad 42, the wafer W is brought into sliding contact with the polishing pad 42 so as to be polished.

Figure 3:
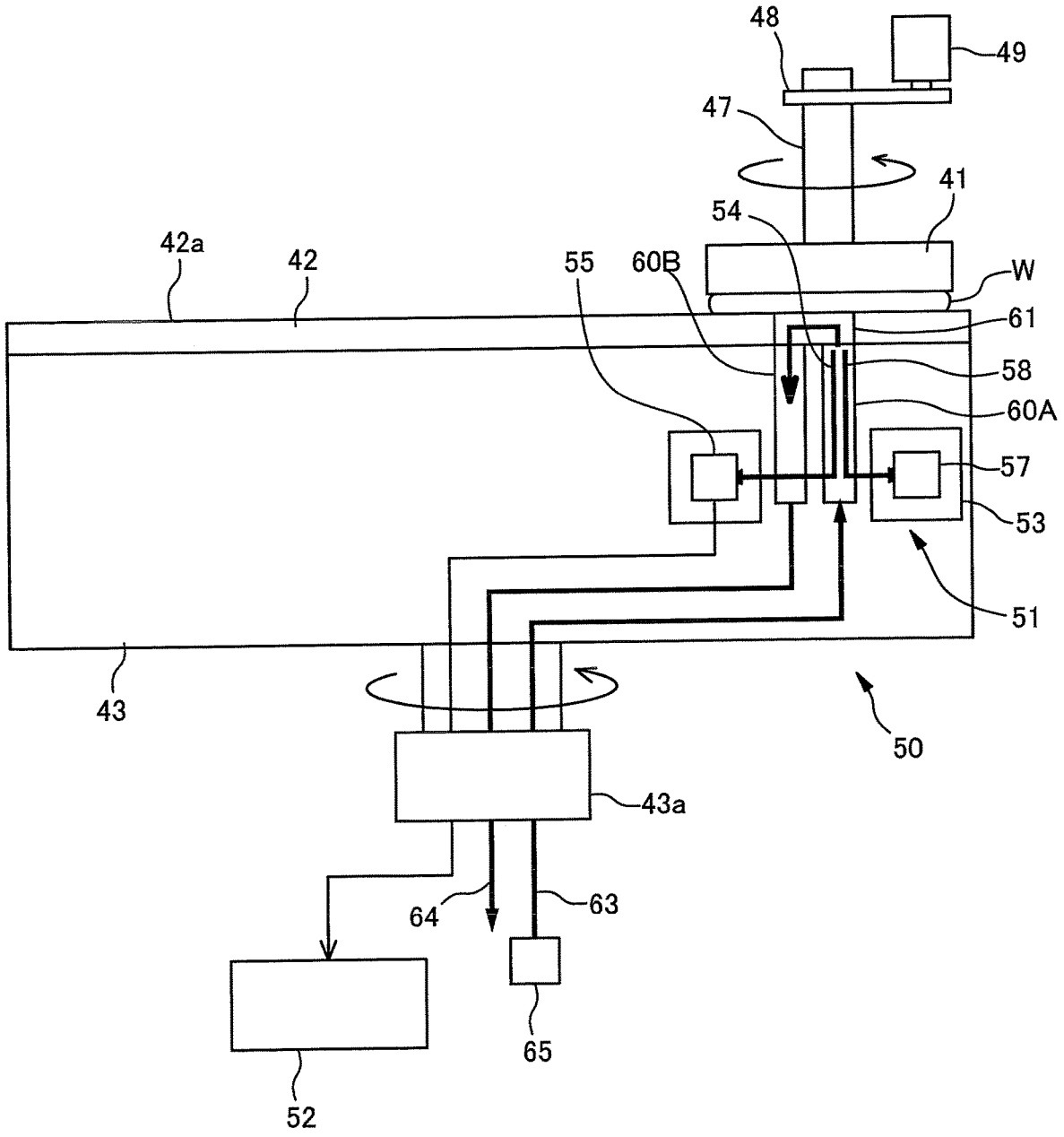
FIG. 3 is an explanatory diagram illustrating the configuration of the film thickness measurement device.

FIG. 3 is a cross-sectional view that illustrates the configuration of the film thickness measurement device 50. The top ring shaft 47 is connected to a polishing head motor 49 via a connecting means 48 such as a belt and configured to be rotatable. As a result of the rotation of the top ring shaft 47, the top ring 41 rotates in the direction indicated by the arrow.

The film thickness measurement device 50 includes an optical sensor 51 and a processing unit 52, and its operation is comprehensively controlled by the control device 15. The optical sensor 51 is configured to irradiate the surface of the wafer W with light, receive the reflected light that has been reflected from the wafer W, and decompose the reflected light according to the wavelength. The optical sensor 51 includes a light projection unit 53 configured to irradiate the surface to be polished of the wafer W with light, an optical fiber 54 as a light receiving unit configured to receive the reflected light coming back from the wafer W, and a spectroscope 55 configured to decompose the reflected light from the wafer W according to the wavelength and measure the intensity of the reflected light over a predetermined wavelength range.

A first hole 60A and a second hole 60B are formed in the polishing table 43 such that they are opened on the upper surface thereof. Through holes 61 are formed in the polishing pad 11 at positions corresponding to the holes 60A and 60B. The holes 60A and 60B communicate with a through hole 61, and the through hole 61 is opened on the polishing surface 42*a*. The first hole 60A is connected to a liquid supply source 65 via a liquid supply path 63 and a rotary joint (not shown), and the second hole 60B is connected to a liquid discharge path 64.

The light projection unit 53 includes a light source 57 that emits light having multiple wavelengths, and an optical fiber 58 connected to the light source 57. The optical fiber 58 is a light transmission unit configured to guide the light emitted by the light source 57 to the surface of the wafer W. The tips of the optical fibers 58, 54 are located in the first hole 60A, and are positioned in the vicinity of the surface to be polished of the wafer W. The tips of the optical fibers 58, 54 are arranged to face the wafer W held by the top ring 41. Multiple regions of the wafer W are irradiated with the light every time the polishing table 13 rotates. Preferably, the tips of the optical fibers 58, 54 are arranged to pass through the center of the wafer W held by the top ring 41.

During the polishing of the wafer W, water (preferably pure water) as a transparent liquid is supplied from the liquid supply source 65 to the first hole 60A via the liquid supply path 63, and the space between the lower surface of the wafer W and the tips of the optical fibers 58, 54 is filled therewith. The water from the liquid supply source 65 further flows into the second hole 60B and is discharged through the liquid discharge path 64. The polishing liquid is discharged together with water, thereby an optical path is allowed to exist. A valve (not shown) that operates in synchronization with the rotation of the polishing table 43 is provided in the liquid supply path 63. When the wafer W is not positioned above the through hole 61, this valve operates so as to stop the flow of water or decrease the flow rate of the water.

The two optical fibers 58, 54 are arranged in parallel to each other, and the respective tips are arranged perpendicularly to the surface of the wafer W. The optical fiber 58 is configured to irradiate the surface of the wafer with light perpendicularly to the surface of the wafer W.

During polishing of the wafer W, the wafer W is irradiated with light from the light projection unit 51, and reflected light from the wafer W is received by the optical fiber (light receiving unit) 54. The spectroscope 55 measures the intensity of the reflected light at each wavelength over a predetermined wavelength range, and sends the obtained light intensity data to the processing unit 52. This light intensity data is an optical signal that indicates the film thickness of the wafer W, and is made up of the intensity of the reflected light and the corresponding wavelength.

Figure 4:
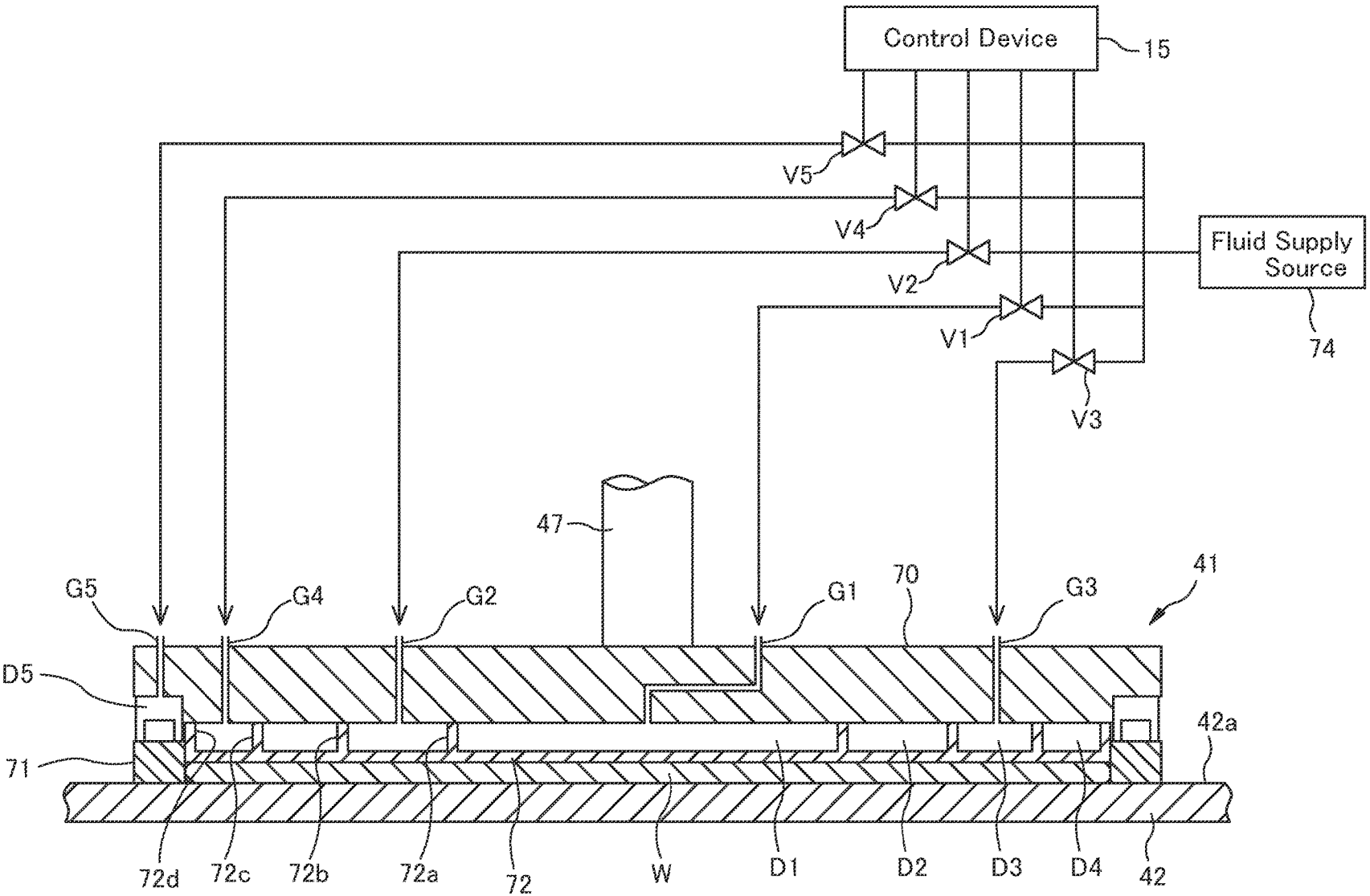
FIG. 4 is a side view partly illustrating the configuration of the substrate polishing unit component.

As illustrated in FIG. 4, the top ring 41 includes a head main body 70 fixed to the lower end of the top ring shaft 47, a retainer ring 71 supporting the side edge of the wafer W, and elastic film 72 that presses the wafer W on the polishing surface of the polishing pad 42. The retainer ring 71 is disposed so as to surround the wafer W and is connected to the head main body 70. The elastic film 72 is attached to the head main body 70 so as to cover the lower surface of the head main body 70.

The head main body 70 is formed of a resin such as engineering plastic (e.g., PEEK), and the elastic film 72 is formed of a rubber material excellent in strength and durability such as ethylene propylene rubber (EPDM), polyurethane rubber, silicone rubber, and the like.

The top ring main body 70 and the retainer ring 71 constituting the top ring 41 are configured to rotate integrally by the rotation of the top ring shaft 47.

The retainer ring 71 is disposed so as to surround the top ring main body 70 and the elastic film 72. The retainer ring 71 is a member made of a ring-shaped resin material contacting the polishing surface 42*a* of the polishing pad 42, and is arranged so as to surround the outer peripheral edge of the wafer W held by the top ring main body 70. The retainer ring 71 supports the outer peripheral edge of the wafer W so that the wafer W being polished does not get out of the top ring 41.

An annular retainer ring pressing mechanism (not illustrated) is connected to the upper surface of the retainer ring 71 so as to impart a uniform downward load on the entire upper surface of the retainer ring 71. By virtue of this, the lower surface of the retainer ring 71 is pressed against the polishing surface 42*a* of the polishing pad 42.

The elastic film 72 is provided with a plurality (four in FIG. 4) of annular peripheral walls 72*a*, 72*b*, 72*c*, 72*d* arranged concentrically. The peripheral walls 72*a* to 72*d* define, between the upper surface of the elastic film 72 and the lower surface of the head main body 70, the circular first pressure chamber D1 residing at the center and the annular second, third, and fourth pressure chambers D2, D3, D4.

A flow path G1 communicating with the first pressure chamber D1 at the center and flow paths G2 to G4 communicating with the second to fourth pressure chambers are formed, respectively, in the head main body 70. These flow paths G1 to G4 are individually connected to the fluid supply source 74 via fluid lines. On-off valves V1 to V4 and a pressure controller (not illustrated) are installed on the fluid line.

A retainer pressure chamber D5 is formed right above the retainer ring 71. The retainer pressure chamber D5 is connected to the fluid supply source 74 via a flow path G5 formed in the head main body 70, and a fluid line (not illustrated) on which an on-off valve V5 and a pressure controller (not illustrated) is installed. The pressure controller installed on the fluid line has a pressure adjusting function for adjusting the pressure of the pressure fluid supplied from the fluid supply source 74 to the pressure chambers D1 to D4 and the retainer pressure chamber D5. Actuation of the pressure controller and the on-off valves V1 to V5 can be controlled by the control device 15.

Figures 5, 6:
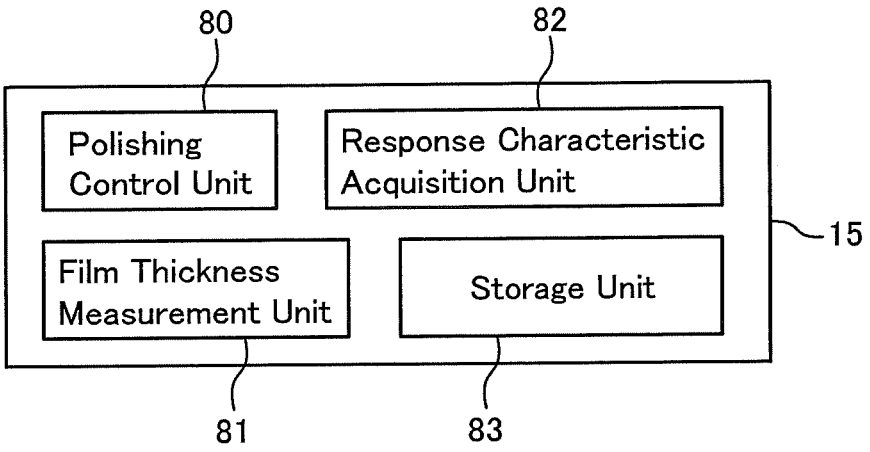
FIG. 5 is an explanatory diagram illustrating an example configuration of a control device.
FIG. 6 is an explanatory diagram illustrating an example of preset conditions of respective pressure chambers.

FIG. 5 illustrates an example of the configuration of the control device 15. The control device 15 includes a polishing control unit 80, a film thickness measurement unit 81, a response characteristic acquisition unit 82, and a storage unit 83. The control device 15 is configured to comprehensively control the operation of the polishing unit component 40. It should be noted here that the configuration of the control device 15 is not limited to the one illustrated in FIG. 5 and it will be appreciated that the control device 15 includes the features for controlling the operations of the other components of the substrate processing device 10 (e.g., the load/unload unit 12 and the cleaning unit 14).

The polishing control unit 80 is configured to control the operations of the top ring 41, the polishing table 43, and the like constituting the polishing unit component 40 and perform the polishing process on the wafer W held by the top ring 41. The film thickness measurement unit 81 is configured to control the operation of the film thickness measurement device 50 and measure in real time a film thickness profile of the wafer W that is being polished. The storage unit 83 stores configuration data such as a preset pressure which will be described later as well as programs for controlling the operation of the substrate processing device 10. The program for controlling the operation of the substrate processing device 10 may be installed in a computer constituting the control device 15 in advance or may be stored in a storage medium such as CD-ROM, DVD-ROM, and the like, or may be installed on the control device 15 via the Internet.

With regard to an algorithm for estimating the film thickness of the wafer W, the film thickness measurement unit 81 may use, for example, a reference spectrum (fitting error) algorithm or an FFT (fast Fourier transform) algorithm.

According to the reference spectrum algorithm, a plurality of spectrum groups including a plurality of reference spectra corresponding to different film thicknesses are prepared. The spectrum group that includes a reference spectrum whose shape is most similar to that of the spectrum signal from the processing unit 52 (reflectance spectrum) is selected. Further, during the polishing of the wafer, a measurement spectrum for measuring the film thickness is generated, the reference spectrum having the most similar shape is selected from among the selected spectrum groups, and the film thickness corresponding to the reference spectrum is estimated as being the film thickness of the wafer that is being polished.

According to the FFT algorithm, the spectrum signal (reflectance spectrum) from the processing unit 52 undergoes FFT (fast Fourier transform) to extract the frequency component and its intensity, and the frequency component that has been obtained is converted into the thickness of the layer to be polished using a predetermined relational expression (which is a function that represents the thickness of the layer to be polished and is obtained from the results of the actual measurements). As a result, frequency spectrum is generated which represents the relationship between the thickness of the layer to be polished and the intensity of the frequency component. If the peak intensity of spectrum for the thickness of the layer to be polished converted from the frequency component has exceeded a threshold, then the frequency component (the thickness of the layer to be polished) corresponding to this peak intensity is estimated as being the film thickness of the wafer that is being polished.

An eddy current (resistance eddy current monitor) scheme may be used in combination with or in place of the above-described schemes to measure the film thickness of the wafer W. According to this scheme, a sensor coil is disposed in the vicinity of a wafer provided with a conductive film, an alternating current of a constant frequency is supplied to form an eddy current in the conductive film, and the impedance including the conductive film as viewed from both terminals of the sensor coil is measured. The measured impedance is output such that a resistance component, a reactance component, a phase, and an amplitude are separately output, and the thickness of the conductive film is estimated by detecting the change.

The response characteristic acquisition unit 82 is configured to acquire the response characteristic (the polishing rate when the load of each pressure chamber is changed) of the polishing unit component 40 for controlling the polishing film thickness of the wafer W (pressure feedback control). Specifically, the polishing of the wafer W is performed while the pressures in the individual pressure chambers D1 to D5 are changed, the film thickness profile is acquired by the film thickness measurement unit 81 to compute the polishing rate, the multiple linear regression analysis which will be described later is performed, and thus the response characteristic of the polishing unit component 40 is acquired.

FIG. 6 illustrates the preset pressures (pressure conditions) of the individual pressure chambers for acquiring the response characteristic, where the preset pressures are specified such that the preset pressures of the pressure chambers vary depending on the pressure conditions. According to the pressure condition 1, the preset pressures of the individual pressure chambers D1 to D5 are specified as A1P to A5P (reference pressures), respectively. According to the pressure condition 2, the preset pressure in the pressure chamber D1 is specified as A1P*0.9 (90% of the preset pressure (reference pressure) according to the pressure condition 1). Also, according to the pressure condition 3, the preset pressure in the pressure chamber D1 is specified as A1P*1.1 (110% of the reference pressure).

Likewise, according to the pressure condition 4, the preset pressure in the pressure chamber D2 is specified as A2P*0.9 (90% of the reference pressure) and, according to the pressure condition 5, the preset pressure in the pressure chamber D2 is specified as A2P*1.1 (110% of the reference pressure). In the same manner as above, the subsequent pressure conditions are specified such that the pressure only changes in the pressure chambers D3, D4, and D5, respectively. According to the example illustrated in FIG. 6, the first to M-th pressure conditions are defined.

It should be noted that the example illustrated in FIG. 6 is an example where the pressure condition is defined but the present invention is not limited to this preset condition (the example where the preset pressure of one pressure chamber is specified as 90% or 110% of the reference value) and, for example, the preset pressures may be changed for multiple times, for example, in 5% increments such as 85%, 90%, and 95%. Alternatively, the pressure conditions may be defined such that the preset pressures in multiple pressure chambers may be changed from the reference value.

Also, although the present embodiment is described based on the example where five pressure chambers are provided, the number of the pressure chambers is not limited to this and can be increased or decreased as appropriate. Further, although the present embodiment determines the preset pressure including the pressure chamber of the retainer ring, the pressure condition may be set only in the pressure chamber excluding the retainer ring.

Figure 7:
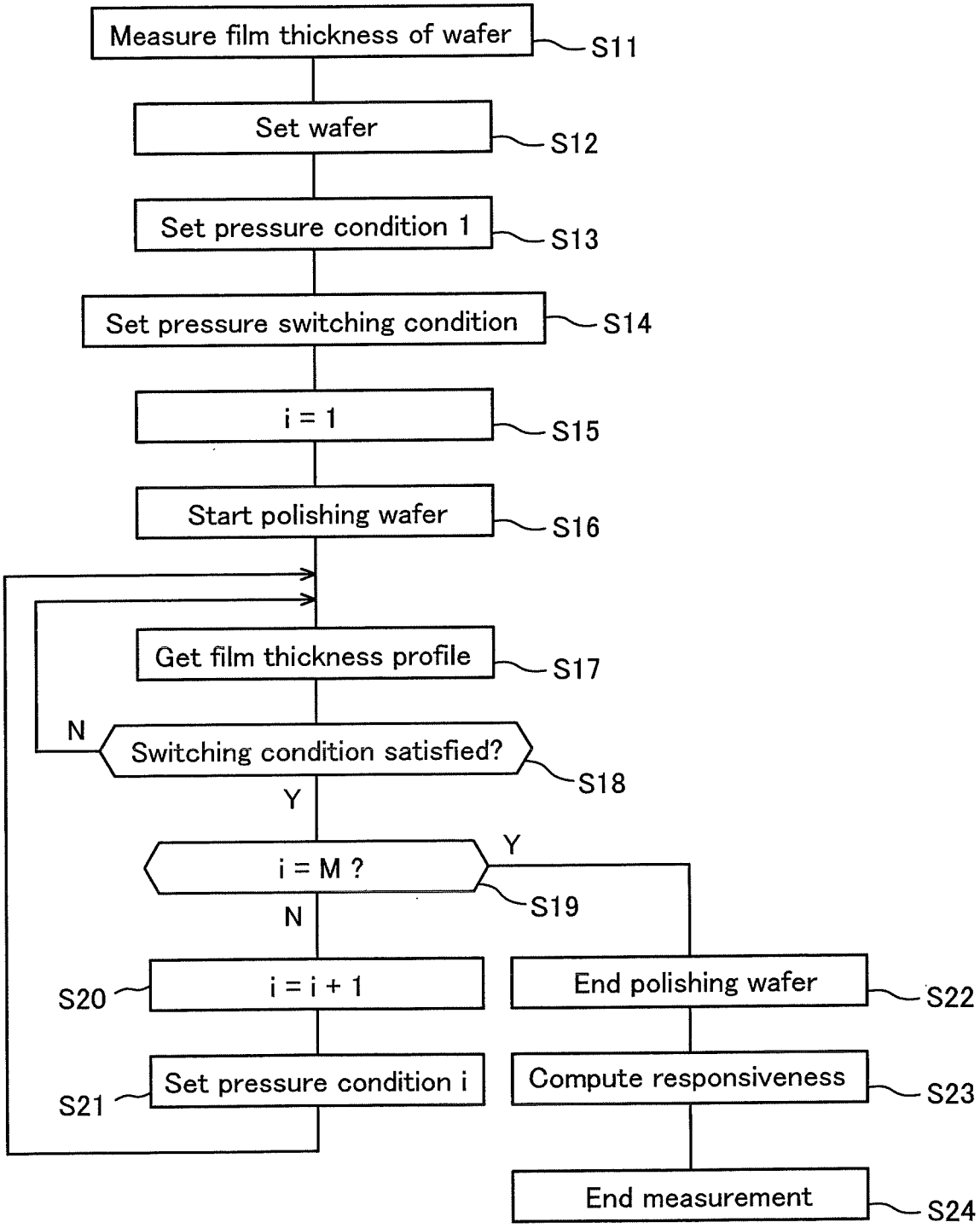
FIG. 7 is a flowchart illustrating a processing procedure for acquiring a response characteristic.

The response characteristic acquisition unit 82 acquires the response characteristic for example in accordance with the flowchart illustrated in FIG. 7. First, the film thickness of the wafer W prior to the test polishing is measured using a not-shown external film thickness measurement device (S11). Next, the wafer W whose film thickness has been measured in the step S11 is set in the polishing unit component 40 (S12) and the polishing control unit 80 specifies the pressures of the individual pressure chambers D1 to D5 such that they corresponds to the predetermined pressures specified according to the preset pressure 1 (condition 1)

(i.e., such that the pressures of the individual pressure chambers corresponds to the reference values A1P to A5P, respectively) (S13).

Next, the response characteristic acquisition unit 82 specifies the timing at which the preset pressure during the polishing is to be switched (switching condition) (S14). As the timing for switching of the preset pressure, for example, the preset pressure can be switched when the amount of polishing of the wafer W obtained from the film thickness of the wafer W measured by the film thickness measurement device 50 (the difference from the initial film thickness measured in the step S11) reaches a preset value (e.g., a setting value defined for every several nanometers). Alternatively, the preset pressure may be switched when the polishing time after the start of the polishing of the wafer W reaches a preset value (e.g., a setting value defined for every several seconds).

Subsequently, the response characteristic acquisition unit 82 sets the variable i indicative of the number of the preset pressure to 1 (S15) and starts the polishing of the wafer W (S16). The film thickness profile (film thickness distribution in the radial direction) of the wafer W that is being polished is measured by the film thickness measurement unit 81 at regular time intervals and the measurement results of the measurements are stored in the storage unit 83 (S17). Determination is made as to whether or not the above-described switching condition for switching the preset pressure (the amount of polishing or the polishing time of the wafer W) is satisfied (S18). If it has been satisfied, then the process goes to the step S19. If it is not satisfied, the process goes back to the step S17 to measure the film thickness profile and the result of the measurement is stored in the storage unit 83.

In the step S18, when the switching condition has been satisfied, determination is made as to whether or not the variable i has reached the maximum value (M) (S19). If the variable i is smaller than the maximum value, then the response characteristic acquisition unit 82 adds 1 to the variable i (S20) and the next pressure condition is specified (S21). In addition, the polishing of the wafer W continues with the pressure that has been specified again and the measurement of the film thickness profile is performed with the preset pressure that has been changed (S17).

On the other hand, if the variable i has reached the maximum value M, measurement of the film thickness profile with all the preset pressures have been completed, and thus the test polishing of the wafer W is completed (S22). In addition, the response characteristic acquisition unit 82 computes the polishing rate (actual polishing rate) from the film thickness profiles for the respective pressure conditions stored in the storage unit 83 and subjects the results of the computation to the multiple linear regression analysis and thereby computes the response characteristic of the polishing unit component 40 (S23).

The response characteristic in accordance with the multiple linear regression analysis can be acquired, for example, by the following scheme. Here, the actual polishing rates for each pressure condition is given as $R.R_{DOE}$, and the prediction computation expression $R.R_i$ of the polishing rate is defined as follows:

$$R.R_i = b_0 + b_1 * AP1_i + b_2 * AP2_i + b3 * AP3_i + b_4 * AP4_i + b_5 * AP5_i$$

where b is the response coefficient and AP is the preset pressure in each pressure chamber.

The response characteristic acquisition unit 82 computes the combination of the response coefficients $b_0$ to $b_5$ which guarantees that the residual error (see the following expression) between the actually measured value $R.R_{DOE}$ of the polishing rate and the prediction computation expression expressed by the following expression becomes smallest.

$$\sum_{i=1}^{M} (R \cdot R_{DOEi} - R \cdot R_i)^2 \quad \text{[Math. 1]}$$

The pieces of data of the response coefficients $b_0$ to $b_5$ that have been computed are stored in the storage unit 83 and thus the measurement of the response characteristic is completed (S24). The pieces of data of the response coefficients $b_0$ to $b_5$ that have been acquired are read as appropriate when the feedback control is performed on the pressure chambers D1 to D5 while the wafer W is being polished.

As described above, the substrate polishing device according to the present embodiment is capable of acquiring the response characteristic of the substrate polishing in the pressure feedback control by only one round of test polishing. Accordingly, it is not necessary to prepare test wafers on a per-preset-pressure basis and it is made possible to acquire the response characteristic in a simplified and cost-effective manner.

Further, in the substrate polishing device according to the present embodiment, since the response characteristic is acquired by measuring in real time the film thickness on the wafer W being polished, the influence of the deviation of the film thickness distribution due to the positional displacement of the wafer during the polishing can be removed and it is made possible to obtain more accurate response characteristic as compared with the conventional method which uses an external film thickness measurement device and measures the film thickness for the wafer that has been subjected to the test polishing.

Figure 8:
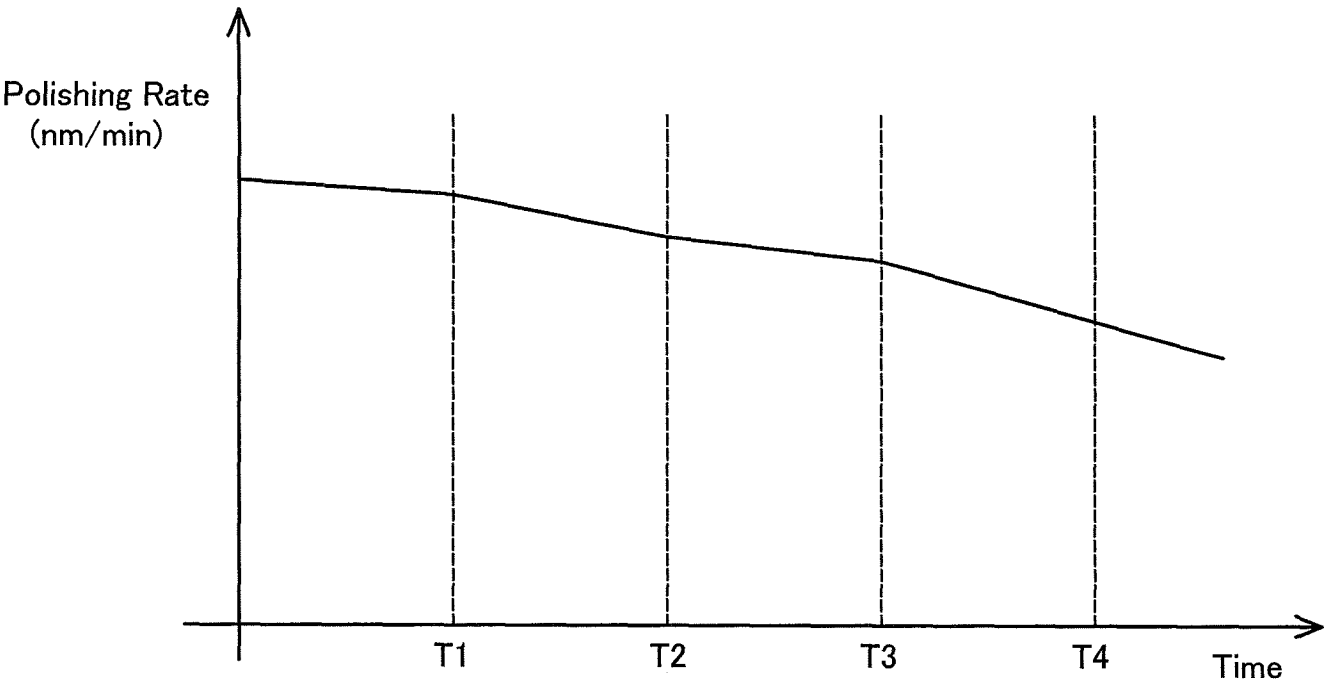
FIG. 8 is an explanatory diagram illustrating an example of temporal change of a polishing rate.

It is presupposed in the above embodiment that the polishing rate when the preset pressure in the pressure chamber is fixed is constant. Meanwhile, in an actual device, the fixed preset pressure does not guarantee that the polishing rate is always constant, and the polishing rate fluctuates depending on the polishing time, for example, as illustrated in FIG. 8 due to factors such as change in the film thickness of the wafer. Accordingly, it is desirable to reduce the influence of the temporal change of the polishing rate to the extent possible in acquiring the response characteristic.

In view of the above, the influence of the temporal change of the polishing rate can be reduced by normalization with the polishing rate of the wafer polished with the preset pressure serving as the reference (the reference pressure corresponding to the preset condition 1 of FIG. 6). Specifically, if the temporal change of the polishing rate at which the wafer (reference wafer) is polished under the reference pressure is given as B(t), then the average value Ave_B of the polishing rates at all time points of the reference wafer will be expressed by the following expression:

$$\text{Ave_B} = \sum_{k=1}^{n} \left( \frac{B(tk)}{n} \right) \quad \text{[Math. 2]}$$

In addition, the polishing rate at the time point "t" at which the wafer to be subjected to the measurement has been polished under the pressure condition i (where i is a number between 1 and M) (i.e., the polishing rates for the respective pressure conditions obtained by polishing the wafer in accordance with the flowchart of FIG. 7) is given as Xi(t), then the normalized polishing rate Xi_Norm(t) can be expressed by the following expression:

$$Xi_\mathrm{Norm}(t)=\mathrm{Ave}_B^*(Xi(t)/B(t))$$

The response characteristic acquisition unit 82 uses the polishing rate Xi_Norm(t) that has been computed in accordance with the above expression (standardized by the reference wafer), computes the response characteristic by multiple linear regression analysis, and stores the response characteristic that has been computed in the storage unit 83. By virtue of this, it is made possible to reduce to the extent possible the influence of the temporal change of the polishing rate.

The above-described embodiments are described for the purpose of enabling the person of ordinary skill in the technical field to which the present invention pertains to implement the present invention. Implementation of various modifications to the above embodiments will be obvious to those skilled in the art and the technical idea of the present invention is also applicable to other embodiments. The present invention is not limited to the embodiments described herein and should be construed in its broadest scope in accordance with the technical idea defined by the claims.

What is claimed is:

1. A substrate processing apparatus for polishing a substrate by pressing the substrate against a polishing pad, the substrate processing apparatus comprising:

a polishing head comprising an elastic film defining a plurality of pressure chambers for pressing the substrate;

a retainer ring;

a computer configured to perform pressure feedback control by individually controlling pressures in the plurality of pressure chambers;

the computer in communication with a sensor configured to measure a film thickness distribution of the substrate being polished;

a non-transitory storage medium configured to store multiple pieces of information on a plurality of preset pressures of the plurality of pressure chambers; and the computer in communication with a plurality of valves and in communication with the sensor, the computer further configured, during polishing a single substrate, to change the pressure of at least one pressure chamber to one of the plurality of preset pressures for at least one of the plurality of pressure chambers defined by the elastic film to press a portion of the substrate corresponding to the at least one of the plurality of pressure chambers each time one of a plurality of predetermined conditions is satisfied during polishing of the substrate by controlling at least one of the plurality of valves, to measure a polishing rate applied to the substrate, to acquire a response characteristic of the polishing of the substrate, and to store in the non-transitory storage medium the acquired response characteristic corresponding to each of the preset pressures of the plurality of pressure chambers, wherein the response characteristic indicates responsiveness of the polishing of the substrate to the pressure feedback in the plurality of pressure chambers, wherein one of the plurality of predetermined conditions is that a certain period of time has elapsed or an amount of the polishing of the substrate has reached a predetermined amount; and wherein the plurality of preset pressures for the at least one pressure chamber are predefined.

2. The substrate processing apparatus according to claim 1, wherein a plurality of the preset pressures include a reference pressure condition including reference values for the pressure chambers and the plurality of preset pressure conditions obtained by changing only the pressure value in one pressure chamber from the reference pressure condition.

3. The substrate processing apparatus according to claim 2, wherein the computer is further configured to acquire a reference rate indicative of temporal change of a polishing rate on the basis of the reference pressure condition, perform standardization of the polishing rate that has been obtained by performing the polishing under the preset pressures in sequence, the standardization being performed on the basis of the reference rate, and thereby correct the polishing rate.

4. The substrate processing apparatus according to claim 1, wherein the computer is further configured to measure the polishing rates by performing the polishing on one substrate under the preset pressures in sequence.

* * * * *